US006758546B2

(12) United States Patent
Hinojosa et al.

(10) Patent No.: US 6,758,546 B2
(45) Date of Patent: Jul. 6, 2004

(54) INKJET PRINTING APPARATUS

(75) Inventors: Antonio Hinojosa, Rubi Barcelona (ES); Joaquim Brugue, Barcelona (ES); Javier Lopez, Barbastro Huesca (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/361,718

(22) Filed: Feb. 10, 2003

(65) Prior Publication Data

US 2003/0132978 A1 Jul. 17, 2003

Related U.S. Application Data

(63) Continuation of application No. 09/930,650, filed on Aug. 15, 2001, now Pat. No. 6,517,179.

(30) Foreign Application Priority Data

Aug. 24, 2000 (EP) ..... 00118446

(51) Int. Cl.[7] ..... B41J 28/38
(52) U.S. Cl. ..... 347/16
(58) Field of Search ..... 347/16, 104, 106; 400/642

(56) References Cited

U.S. PATENT DOCUMENTS 6,517,179 B2 * 2/2003 Hinojosa et al. ..... 347/16

* cited by examiner

*Primary Examiner*—Stephen D. Meier
*Assistant Examiner*—Alfred Dudding

(57) ABSTRACT

The apparatus is provided with a holddown device for a medium lying on a platen, said device comprising first cockle-control means which in a medium output zone downstream of the print zone control an expansion of the medium to be in the form of a wave defined by a plurality of bubbles and substantially adapted in frequency to a ridged surface of the supporting platen; the holddown device may comprise second cockle-control means which control an expansion of the medium in the print zone to be in the form of at least two parallel waves defined by a plurality of bubbles and alternated such that a downward bubble of one of the waves is adjacent to an upward bubble, or no bubble, of an adjacent wave in the direction (Y) of advance of the medium.

The effects of cockle are improved without tensioning the medium downstream from the printing zone, and improving vertical banding.

16 Claims, 5 Drawing Sheets

INKJET PRINTING APPARATUS

CROSS REFERENCE TO RELATED APPLICATIONS

This is a continuation of application Ser. No. 09/930,650 filed on Aug. 15, 2001, now U.S. Pat. No. 6,517,179 which is hereby incorporated by reference herein.

The present invention relates to inkjet printing apparatus, such as printers, copiers, facsimiles and the like, and more particularly it is concerned with a holddown device for the paper or medium being printed in this kind of apparatus.

BACKGROUND OF THE INVENTION

Inkjet printing apparatus, and inkjet printers in particular, are provided with systems or devices, which will be referred hereinafter as holddown devices, that keep the paper flat while it is being printed by a travelling inkjet printhead.

The design of a holddown device to keep the paper flat at least in the print zone of the apparatus must deal with a number of contrasting issues.

On one hand, for instance, the distance between the printhead and the paper must be as small as possible, for example less than 1.7 mm, in order to obtain an accurate positioning of the ink dots projected from the printhead and to avoid spraying artifacts.

However, due to the water content of the ink, the paper is subject to a phenomenon known as "cockle" consisting in the swelling and expansion of the paper during the printing operation, such that the paper forms bubbles and wrinkles and as a result the distance between the paper and the printhead decreases in some areas. Cockle can cause two major drawbacks: first of all, the risk of ink smearing or paper crash because the printhead touches the paper, and further the appearance of visible defects in the printout, known as "vertical banding", because due to the presence of a bubble the ink dots fall in points offset from their correct position, e.g. all displaced towards the same side, leaving visible marks on the plot in the form of parallel lines.

Some devices known in the art provide a negative air pressure under the medium in order to maintain it flat in the print zone.

One example of such a vacuum holddown device is described in EP-A-0 997 302. This device includes a platen, on which the paper is kept flat, which partially overlaps the paper drive roller. A plurality of grooves, all connected to a vacuum source, are formed in the platen, the aim of said grooves being to extend the vacuum and therefore the holddown action towards the drive roller, in order to allow more accuracy in the printing operation while keeping at the same time the drive roller out of the vacuum system.

In practice, in order to control the cockle effect in high quality printing this vacuum holddown system requires the provision of overdrive wheels or a similar tensioning device in the front part of the platen, i.e. downstream of the printing zone, in order to tension the paper in the feeding direction while it is being printed. This solution makes the holddown system complicated, and its cost is quite high.

Other solutions, such as heaters or fans to dry the media during printing, have high power requirements and safety problems.

Increasing the vacuum to reduce cockle is also not a good solution, because higher vacuum levels increase the cost, bring about noise problems and the risk of creasing the paper, and also hinder the advance of the media being printed.

DESCRIPTION OF THE INVENTION

The present invention seeks to provide an improved inkjet printing apparatus, having a holddown device simpler in construction and lower in cost with respect to the prior art which can successfully neutralise the effects of wet cockle in the print zone.

Accordingly, the inkjet printing apparatus of the present invention is provided with a holddown device for a medium lying on a media supporting platen on which a print zone is defined, and is characterised in that said holddown device comprises first cockle-control means which, at least in a medium output zone arranged downstream of the print zone in the direction of advance of the medium, control an expansion of the medium to be in the form of a wave defined by a plurality of bubbles, said wave being substantially adapted in frequence to a ridged surface of the supporting platen.

By controlling the shape of the deformed medium, the invention successfully achieves a reduction of the height of the wrinkles or bubbles caused by cockle. This effect is achieved by forcing the medium to adopt a wave form that "copies" the underlying support platen, which has a ridged surface, i.e. a surface having a succession of incuts and projections.

Advantageously, said wave generated in the output zone is induced to reproduce upstream towards the print zone.

Thus, the bubbles are generated outside the print zone and are induced to propagate towards and partly into the print zone; this controlled generation and propagation avoids the negative effects of free expansion of the paper due to cockle in the print zone, and the bubble height is kept small.

With this reduction of height of the bubbles, the risk of contact of the medium with the printheads is thus much lower than if the paper expands in a free shape.

This makes the printer according to the invention particularly suitable for applications in which it is especially important to avoid down times and non-programmed maintenance operations.

The cost of the holddown system is significatively lower than in prior art solutions, since no tensioning of the medium from the front part of the printer is needed to control the cockle effect.

Another advantage of avoiding the use of tensioning devices is that there is no appreciable difference in the drive between the first passes and the rest of the printing operation; on the contrary, when a tensioning device is used the advance of the paper in the first passes can be different from the advance once the paper is engaged by the tensioning device, causing differences in the plot.

In case of vacuum holddown devices, the avoidance of overdrive wheels also simplifies the construction of the vacuum system and minimises its power losses, since there are no mechanical parts of the driving system housed in the vacuum conduits. Therefore, the power consumption of the holddown system is also reduced, and the level of noise caused by the vacuum system is also lower.

In the preferred embodiment of the invention, said first cockle-control means cause at least some of the bubbles to expand downwards into a plurality of front vacuum channels of the supporting platen which extend at least in the output zone.

Bubbles and wrinkles due to cockle grow downwards into the front vacuum channels instead of growing upwards towards the printhead: the risk of ink smearing or paper crash is thus further reduced.

Moreover, since most of the expansion of the medium can be controlled to grow downwards instead of upwards, it is possible to reduce the height of the printheads on the medium (pen-to-paper spacing), thus improving the quality of the plot.

In advantageous embodiments, the distance between centres of adjacent front channels of the platen is between 8 and 20 mm, preferably about 13 mm.

This geometry induces a satisfactory wave form of the deformed paper, with bubble heights than cannot cause ink smearing.

This preferred values of the spacing between channels have been selected on the base of the media generally used in this type of printers, but for other kinds of media the optimum spacing may be different; in general, for thicker or stiffer media the distance between channels should be larger, while for thinner and more flexible media, the distance should be smaller.

In one embodiment, said front vacuum channels formed in said supporting platen extend partly in the print zone and partly in the media output zone; preferably, a first portion of the front vacuum channels extending between the print zone and the first part of the output zone widens progressively in the direction of advance of the medium.

The position and geometry of the front vacuum channels allow the growth of the bubbles inside them taking into account their progressive expansion, and prevent bubbles in the output zone from travelling towards the print zone in an uncontrolled way.

In further embodiments of the apparatus, the front vacuum channels may comprise a second portion which narrows with respect to the first portion, and a third portion which is wider than said second portion.

In order to improve the sealing of the vacuum system, the walls of at least one of the portions of the front vacuum channels may be at least partly sloped.

According to another aspect of the invention, an inkjet printing apparatus provided with a holddown device for a medium lying on a media supporting platen on which a print zone is defined, is characterised in that said holddown device comprises second cockle-control means which control an expansion of the medium in the print zone to be in the form of at least two parallel waves defined by a plurality of bubbles, said waves being alternated such that a downward bubble of one of the waves is adjacent to an upward bubble, or no bubble, of an adjacent wave in the direction of advance of the medium.

This expansion in alternate waves in the print zone compensates the positioning errors of the drops of ink that may occur if the medium expands in the print zone forming a uniform wave in the direction of advance of the medium; thus, defects of vertical banding in the plot are avoided.

Preferably, said second cockle-control means comprise a plurality of rear vacuum channels extending at least in the initial part of the print zone and a plurality of front vacuum channels extending at least in the final part of the print zone, said rear vacuum channels and said front vacuum channels being arranged alternated along a scan direction at right angles to said direction of advance of the medium.

The rear vacuum channels extend the vacuum towards the very first part of the printing zone, and the alternance of rear and front channels cause the medium to be deformed as explained in order to avoid vertical banding.

According to a preferred embodiment, the inkjet printing apparatus of the present invention comprises both first cockle-control means and second cockle-control means as defined above.

This combination allows cockle to be controlled with the advantages of simple construction and low cost mentioned above and at the same time avoiding vertical banding in the plot for the vast majority of print modes and types of media.

The present invention also proposes a method for holding down a medium being printed in an inkjet printing apparatus, comprising the step of controlling the cockle expansion of the medium, at least in a medium output zone arranged downstream of a print zone in the direction of advance of the medium, to be in the form of a wave defined by a plurality of bubbles, said wave being substantially adapted in frequence to a ridged surface of a supporting platen.

Preferably the method further comprises the step of inducing at least some of the bubbles to grow downwards in front vacuum channels of the supporting platen.

In an advantageous embodiment, the method comprises the step of controlling the expansion of the medium in the print zone to be in the form of at least two parallel waves defined by a plurality of bubbles, said waves being alternated such that a downward bubble of one of the waves is adjacent an upward bubble, or no bubble, of an adjacent wave in the direction of advance of the medium.

BRIEF DESCRIPTION OF THE DRAWINGS

A particular embodiment of the present invention will be described in the following, only by way of non-limiting example, with reference to the appended drawings, in which.

DESCRIPTION OF A PREFERRED EMBODIMENT

Figure 1:
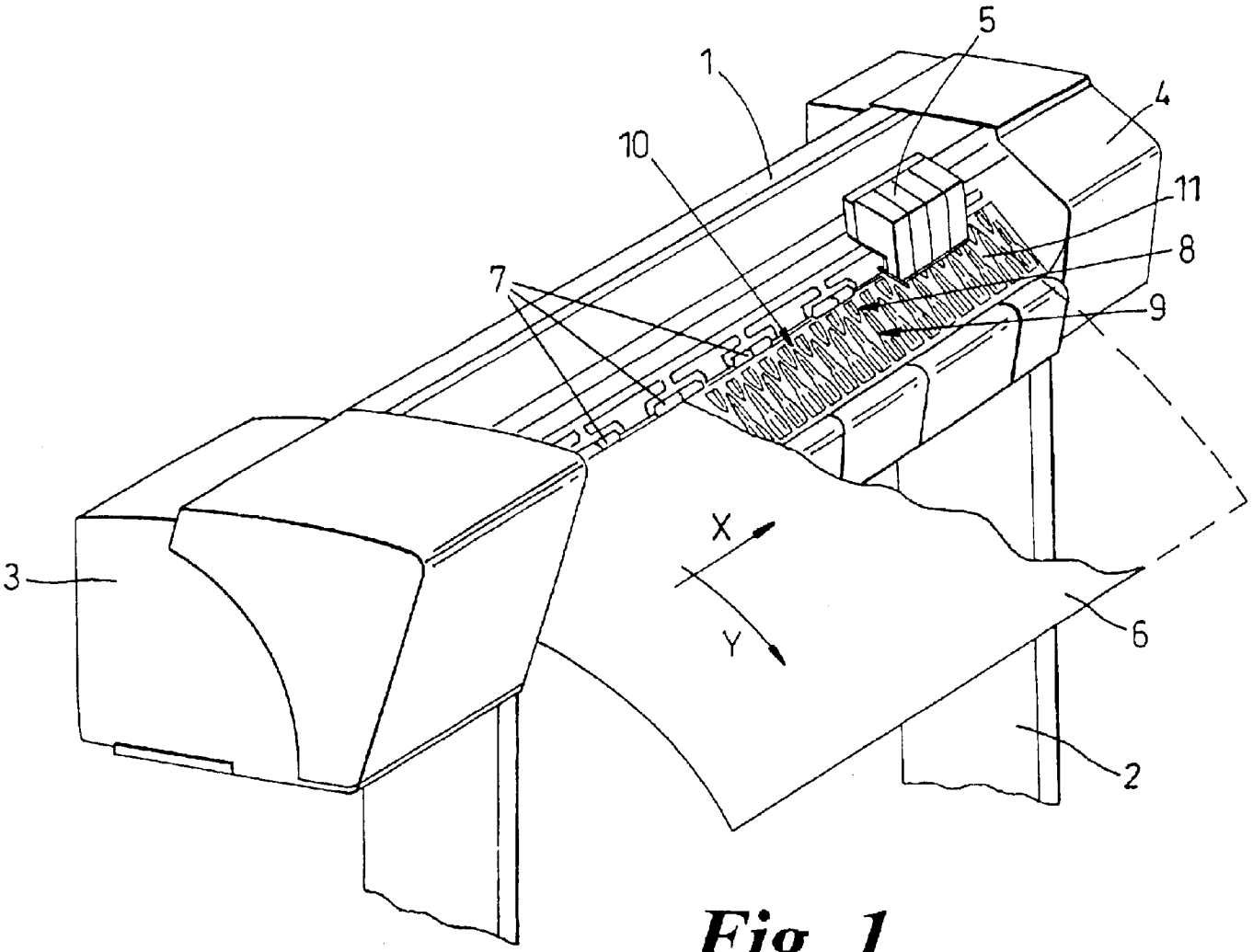
FIG. 1 is a schematic perspective view of an inkjet printer with a holddown device according to the present invention.

In FIG. 1 an inkjet printer has a housing 1 mounted on a stand 2, said housing including left and right mechanism enclosures 3 and 4. Between said enclosures, a carriage 5 with inkjet printheads is mounted for reciprocal motion along a horizontal scan axis (in the direction of the X axis shown in FIG. 1), above a medium 6 to be printed, which is generally a paper sheet or roll. The sheet of paper 6 has been partially cut out in FIG. 1 in order to show the underlying part of the printer.

A main drive roller (not shown) mounted inside the housing 1 and below the medium 6, in cooperation with a plurality of pinch rollers 7, causes the stepwise advance of the medium along a vertical axis (Y axis shown in FIG. 1).

A print zone 8 (best seen in FIGS. 2 and 3) is defined below the path of the carriage 5. The print zone extends to substantially all the dimension along the X axis of the paper being printed and in the present example is about 15 mm wide in the Y direction. As the carriage 5 travels above the print zone 8, selected nozzles of the printheads are activated and dots of ink of the desired colours and in the desired pattern are applied on the paper 6 in the print zone. After the print zone 8 and while the ink dries, the medium travels on to an output zone 9 (FIGS. 2, 3) which is adjacent to the print zone in the feeding direction of the paper, i.e. in the direction of the Y axis.

In one mode of operation, the desired plot may be formed in a single pass of the printheads carriage; the nozzles of each printhead eject corresponding ink drops on the paper and then the paper is displaced a length corresponding to the dimension of the print zone.

In higher quality printing the printheads perform several passes, for example eight, before the paper advances the full length of the print zone: the paper is displaced after each pass a length equal to only $1/8^{th}$ of the dimension of the print zone, and the printheads deposit on the paper in each pass only $1/8^{th}$ of the total amount of ink.

It is important to note that the effect of wet cockle increases with the amount of ink deposited on the paper, and therefore at the beginning of the print zone the effect is smaller than at the end, especially in the case of printing in multiple passes; furthermore, bubbles continue to grow in the paper for some time after the ink is deposited, i.e. while the paper is resting or travelling on the output zone 9.

The printheads don't extend to the output zone 9, and therefore there is no risk of ink smearing in this zone; however, it is very important to control the growth of bubbles or wrinkles in the output zone because in practice it has been ascertained that bubbles formed in the output zone tend to "travel" and expand back towards the print zone 8.

The Applicant has realized that by controlling how bubbles are formed in the output zone, it is then possible to control how the bubbles are then reproduced in the print zone.

Further details of the general structure and operation of the printer, including how a vacuum source can be put in fluid connection with the holddown channels placed into the platen, are deemed not necessary in the present specification; reference can be made to the above mentioned EP-A-0 997 302 for a more detailed description.

According to the invention, a vacuum holddown device 10 is provided under the medium 6, in order to keep the medium flat and minimise the effect of cockle in the print zone 8 and in the output zone 9.

Figure 2:
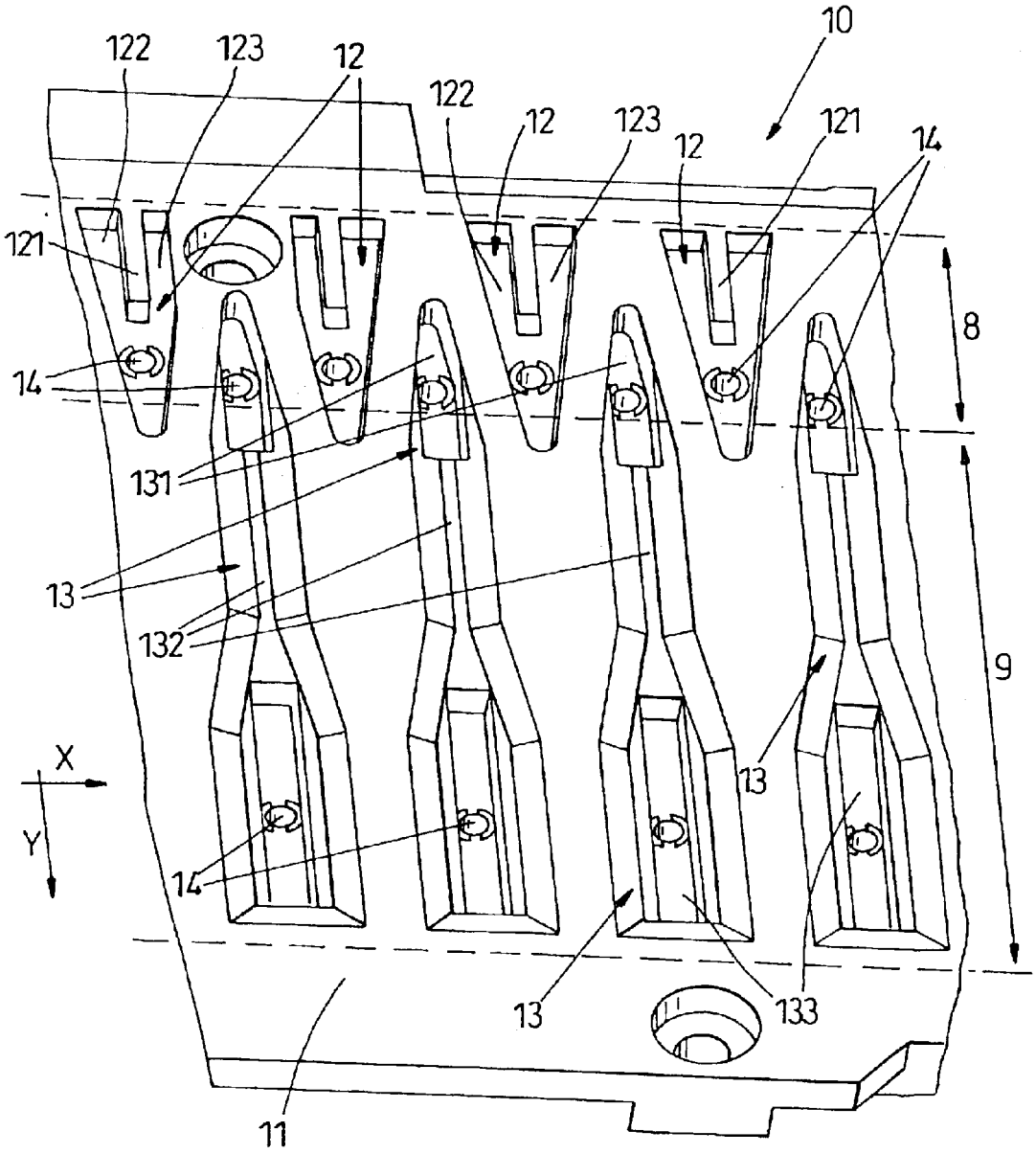
FIG. 2 shows an enlarged detail in perspective view of the platen of the holddown device.
Figure 3:
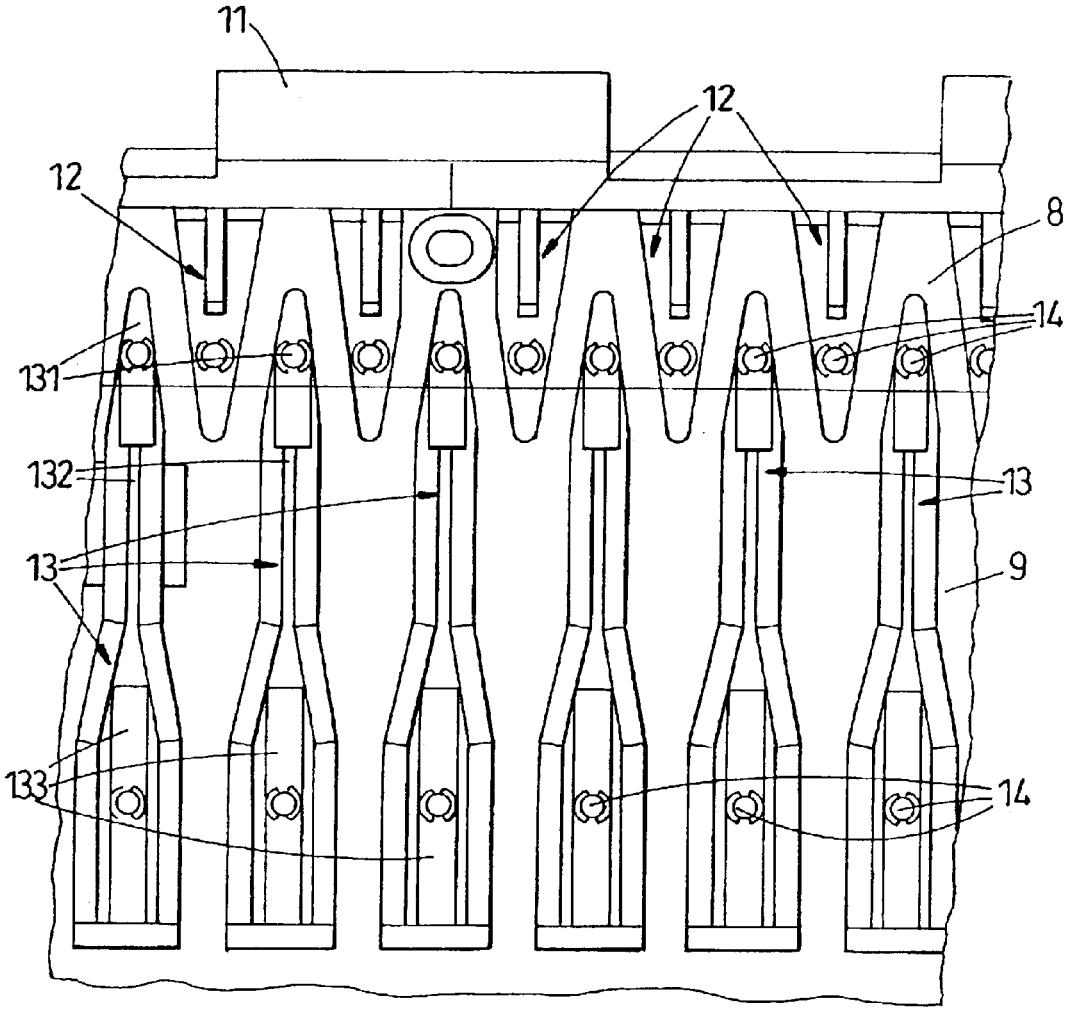
FIG. 3 is a partial plan view of the platen of the holddown device.

The holddown device 10 is shown in more detail in FIGS. 2 and 3. It comprises a substantially horizontal platen 11, on which the paper is supported and through which a negative pressure is transmitted to the medium in order to maintain it substantially flat.

As shown in FIGS. 2 and 3, the platen 11 includes two sets of vacuum channels, which will be named rear vacuum channels 12 and front vacuum channels 13, respectively, in reference to their position along the Y axis.

Rear channels 12 and front channels 13 are different in shape and arranged in side by side relationship and alternated along the X axis. Each of the channels 12,13 communicates with a vacuum source (not shown) through holes 14 formed in the base of the platen.

The rear channels 12 of the first set have a substantially triangular shape, with a base at the beginning of the print zone 8 and a vertex in the first part of the output zone 9; the channels 12 are thus arranged almost entirely in the print zone. Each channel 12 is provided with a central rib 121 extending from the mentioned base and partly splitting the channel in two branches 122,123.

The front channels 13 of the second set are elongate, extending from the print zone into most of the output zone: they are formed by a first or initial triangular portion 131, arranged between two channels 12 and with its vertex in the middle region of the print zone 8, a second or intermediate narrow groove 132 and a third or final large rectangular portion 133.

All the channels 12,13 have their vertex rounded.

The shape of the rear vacuum channels 12 allow to extend the vacuum towards the beginning of the print zone from a hole 14 placed at the end of the print zone, a function similar to that performed by the channels in EP-A-0 997 302 cited above.

The triangular shape of channels 12 is intended to maximise the surface of the platen with vacuum, in order to improve the flatness of the paper; the central rib 121 has the function of preventing the paper from deforming into the channel at this point, being or not being expanded. In the flat area between two channels 12 the paper could form wrinkles or bubbles, but this is the beginning of the print zone and here, even in high quality printing, the medium has only just received a small amount of ink, so the cockle and the resulting deformation are still scarce, not sufficient to cause ink smearing. In fast print mode (one or two passes), the amount of deposited ink is smaller than in best quality mode, and furthermore the time of residence of the wet paper in the print zone is small, and paper expansion is therefore also small.

The first portion 131 of the front channels 13 opens at the middle region of the print zone 8; from here and towards the output zone 9, the front channels 13 progressively widen, allowing the medium to extend downwards into the channel, when it forms bubbles and when the bubbles grow, with the aid of the negative pressure in the channel. It has to be noted that from the middle region of the print zone towards the output zone the vacuum force on the paper increases due to the increase of the section of the triangular portion 131 of the front channels 13.

This first portion 131 of the front channels 13 advantageously extends into the output zone 9, because the bubbles in the medium 6 keep growing after they receive the last dots of ink, as explained above.

This features guarantee that cockle is substantially controlled by keeping the expansion of the medium inside the channels in those areas where its upwards growth would cause a reduction of the pen-to-paper spacing and thus the risk of contact between the printhead and the medium. Further, the ridged surface formed on the platen 11 by the presence of the front vacuum channels 13 forces the paper to expand in a controlled manner, namely adopting a wave form with a frequence adapted to the shape of the platen 11.

More particularly, the wave form is generated in the output zone 9, especially in the final large rectangular portion 133 of the channels 13, where the printing operation is already finished and the media expansion is bigger. The bigger media expansion is then distributed among the portions 133, such that formation of a large bubble is avoided; on the contrary, a number of smaller bubbles is formed, in correspondence to the platen regions between consecutive portions 133, by forcing part of the excess medium to expand into portions 133. The generated wave form is extended towards the print zone 8 by means of the channels 13, such that cockle is controlled in this important zone. Further, in order to avoid defects in the plot due to the shape of the wave, the wave is compensated in the print zone by means of the channels 12, as will be explained later.

The front vacuum channels 13 thus constitute an anti-cockle means, which control the phenomenon and reduces its negative consequences.

In practice, the configuration of the platen 11 of the holddown device of the present invention increases the frequency or number of bubbles formed in the media and controls their expansion, in order to decrease the height of the bubbles that rise upwards. The number of these bubbles, as will be seen hereinafter, is the same as the number of ribs between adjacent channels. The bubble frequency is thus controlled by the platen design, and not depending on the media type.

The skilled in the art may appreciate that the control is twofold. In one way, the plurality of channels 13 allows the holddown device to reduce the maximum height of each upward bubble; on the other side, the upward bubbles are reproduced in predetermined regions of the print zone, i.e. the zones of the platen 11 between two consecutinve portions 131 of channels 13.

However channels 13, while controlling the generation of bubbles in the print zone, may cause vertical banding if left alone to maintain the medium flat in the print zone by forcing a constant deformation of the medium, i.e. causing similar dot misplacement errors at regular positions along the scan axis.

Thanks to the fact that it is known where the upward bubbles are reproduced in the print zone 8, additional channels 12 have been placed in the print zone in order to reduce the artifacts introduced by the design of channels 13 in the printed output.

The deformation of a medium as a result of the combined action of the channels 12,13 will now be explained, with reference to FIG. 4.

As shown in this diagram, the paper 6 cockles slightly upwards in the first part of the print zone 8, between each two consecutive channels 12; but in the second half of the print zone, the bubbles arising in the paper grow downwards into the first portion 131 of the channels 13, in positions that are aligned in the direction of the Y axis with the small upward bubbles formed in the first part of the print zone.

As a consequence of this downward expansion of the paper in the channels 13, in-between this channels the paper bends slightly upwards, but this upward expansion is limited on both sides by the downward thrust of the channels and it does not reach levels that may cause ink smearing.

Figure 4:
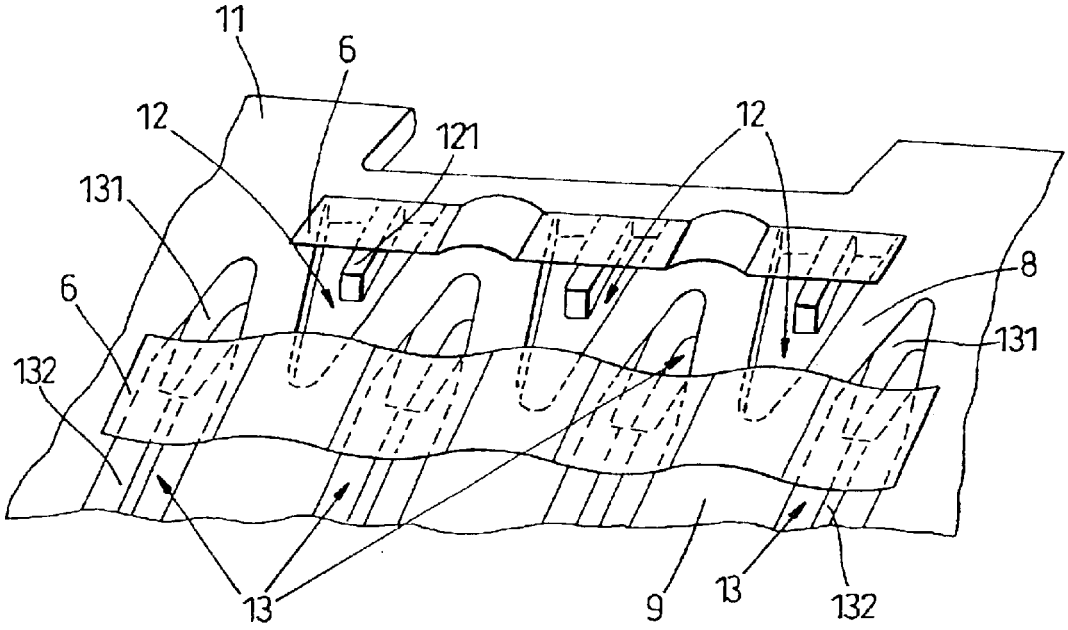
FIG. 4 is a diagram showing the deformation of the medium on the platen.

The advantage of this alternated deformation of the paper in the direction of the Y axis as illustrated in FIG. 4 is important: indeed, a uniform deformation of the paper in the vertical direction (Y axis) can cause vertical banding in the plot, due to the fact that all the drops of ink fall displaced towards the same side from their intended position, leaving a visible pattern on the paper. The alternated deformation of the paper caused by the geometry of the channels 12,13 "breaks" the uniformity in vertical direction and therefore avoids vertical banding.

In multi-pass printing, the amount of ink deposited in each pass is a fraction of the total ink to be deposited, such that each zone of the paper receives a small amount of ink at each pass of the printheads. After each pass, the paper is advanced and therefore the same zone of the paper receives drops of ink while laying in different positions of the platen 11. Thanks to the alternated deformation that is induced in the paper, what happens in multi-pass printing is that the positioning error in the first passes in one zone of the paper, due to the presence of an upward bubble, can be compensated in subsequent passes of the printheads because the same zone of the paper will receive ink while forming a downward bubble, and the positioning error in this case will be different from the previous one; any banding effect in the plot is considerably improved.

The problem of banding is particularly important when printing with thin paper and medium ink density, because in low density the cockle effect is small, while in high density, even if the bubbles are larger and higher, almost all the paper is covered with ink and white banding lines are almost invisible.

The features of the intermediate and final portions 132, 133 of the channels 13 will now be discussed.

The final portion 133 of the channels is wide in order to increase the vacuum surface that holds down the paper; it has to be noted that at this point the printing is already finished, and a larger deformation of the paper down into the channels can be allowed because it will not cause banding or other visible defects in the plot. As already explained, a large upward deformation would travel back towards the print zone and would be reproduced there and would therefore be unacceptable. On the contrary, the wave-form expansion induced in the paper by channels 13 maintains the height of the bubbles to a minimum, when reproduced in the print zone.

However, it is convenient to foresee an intermediate narrow groove 132 in the channel with the function of avoiding a significant air flow, and therefore vacuum losses, at the beginning of the printing operation, when the medium does not cover all the platen 11 but only the print zone 8 and the first part of the output zone 9. If such losses should occur, the paper would not deform into the channels as described. As can be seen in FIG. 2, the groove 132 is also less deep than the initial and final portions 131, 133 of the channel.

Therefore, the groove 132 still provides vacuum to hold down the medium 6 on the platen 11 during normal printing, such that a deformation of the paper is allowed also in this portion of the channel; but in the first printing passes, when the leading edge of the medium 6 is still in the area of the narrow groove 132, only a narrowed air passage is left open, and this allows to significantly reduce the air losses in the vacuum system.

Also for this purpose, each elongate channel 13 has two orifices 14 in communication with the vacuum source, one in the initial portion 131 under the print zone 8 and another one in the final portion 133 in the front part of the printer, and these two orifices are connected to the vacuum source through paths (not shown) that are independent from each other. In the first passes, when the medium does not cover all the length of the channels 13, vacuum is not supplied to the orifices 14 that open in the final portions 133, thus avoiding important losses.

FIG. 2 shows a further feature of the channels 13: instead of being vertical, some walls of the channels are sloped in the intermediate portions 132 and partly sloped in the final portions 133. The aim of the slopes is to make easier the deformation of the paper and to increase the surface of contact between the platen 11 and the medium 6, thus improving the sealing of the vacuum system.

This is especially important near the lateral edges of the medium, in order to avoid vacuum losses and thus reduce power requirements.

In the intermediate portion 132, the sloped surfaces allow to maintain a negative pressure on quite a large surface area of the medium in order to prevent bubbles from travelling back towards the print zone in an uncontrolled manner, and at the same time allow to form the narrow passage to avoid vacuum losses.

Figure 5:
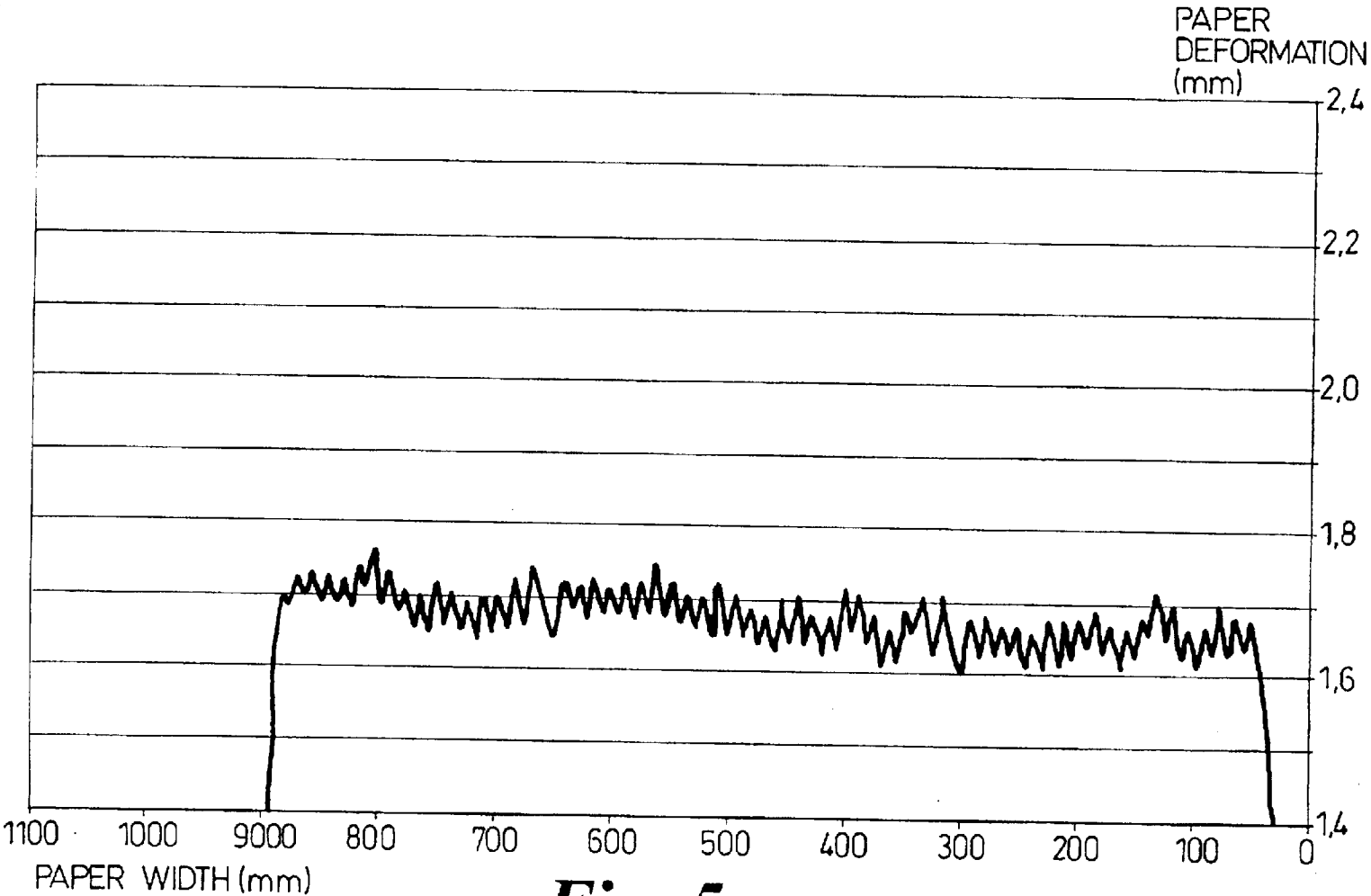
FIG. 5 is a graph showing experimental results.

The holddown device described has been tested with several media kinds, printing qualities and environmental conditions; by way of example, FIG. 5 is a graph showing the maximum deformation in the print zone of a sheet of "Heavy Coated" paper with a width of about 900 mm in the scan (X) direction, being printed with a high density plot in an inkjet printer according to the invention.

In this example, the platen 11 had a distance of 13 mm between each two adjacent front vacuum channels 13. The platen 11 was formed in this case by three parts assembled to each other, and therefore there were two joints between the parts of the platen.

On one hand, the frequency of the bubbles in the graph shows that the deformation of the paper takes place following the ridged shape of the platen 11, with a bubble expanding downwards in each channel 13.

Moreover, it can be seen in the graph that the deformation of the paper as measured by the height between one (upward) peak and the adjacent (downward) peak is normally less than 0.1 mm, which is a very good result and in practice eliminates any risk of contact of the paper with the printheads.

When printing on glossy papers cockle does not arise, and the results with this kind of media are equally good with the printer of the present invention and in prior art devices; in both cases, the paper remains flat on the platen. The only requirement in this case is to avoid the paper deformation in the print zone due to the vacuum force, and this is guaranteed in the holddown device of the invention by the geometry of the rear channels 12.

As explained before, the main problems with cockle arise when printing medium-density plots on thin papers. Even with this worst-case combination results have been excellent, since the maximum height reached by the bubbles, around 0.5 mm, minimises the risk of contact between paper and printheads.

What is claimed is:

1. An inkjet printing apparatus provided with a holddown device for a medium lying on a media supporting platen on which a print zone is defined, said holddown device comprising first cockle-control means which, at least in a medium output zone arranged downstream of the print zone in the direction of advance of the medium, control an expansion of the medium to be in the form of a wave defined by a plurality of bubbles, said wave being substantially adapted in frequency to a ridged surface of the supporting platen, said first cockle-control means being in communication with a vacuum source.

2. An inkjet printing apparatus as claimed in claim 1, wherein said wave generated in the output zone is induced to reproduce upstream towards the print zone.

3. An inkjet printing apparatus as claimed in claim 1, wherein said first cockle control means cause at least some of the bubbles to expand downwards into a plurality of front vacuum channels of the supporting platen which extend at least in the output zone, said plurality of front vacuum channels being in communication with said vacuum source.

4. An inkjet printing apparatus as claimed in claim 3, wherein the distance between centres of adjacent front channels of the platen is between 8 and 20 mm.

5. An inkjet printing apparatus as claimed in claim 4, wherein the distance between centres of adjacent front channels of the platen is about 13 mm.

6. Au inkjet printing apparatus as claimed in claim 3, wherein said front vacuum channels formed in said supporting platen extend partly in the print zone and partly in the media output zone.

7. An inkjet printing apparatus as claimed in claim 6, wherein a first portion of the front vacuum channels, extending between the print zone and the first part of the output zone widens progressively in the direction of advance of the medium.

8. An inkjet printing apparatus as claimed in claim 7, wherein said front vacuum channels comprise a second portion which narrows with respect to the first portion.

9. An inkjet printing apparatus as claimed in claim 8, wherein front vacuum channels comprise a third portion which is wider than said second portion.

10. An inkjet printing apparatus as claimed in claim 7, wherein the walls of at least one of the portions of the front vacuum channel are at least partly sloped.

11. An inkjet printing apparatus as claimed in claim 1 further comprising second cockle-control means which control an expansion of the medium in the print zone to be in the form of at least two parallel waves defined by a plurality of bubbles, said waves being alternated such that a downward bubble of one of the waves is adjacent to an upward bubble, or no bubble, of an adjacent wave in the direction of advance of the medium.

12. An inkjet printing apparatus provided with a holddown device for a medium lying on a media supporting platen on which a print zone is defined, said holddown device comprises first cockle-control means which control an expansion of the medium in the print zone to be in the form of at least two parallel waves defined by a plurality of bubbles, said waves being alternated such that a downward bubble of one of the waves is adjacent to an upward bubble, or no bubble, of an adjacent wave in the direction of advance of the medium, said first cockle-control means being in communication with a vacuum source.

13. An inkjet printing apparatus as claimed in claim 12, wherein said first cockle-control means comprise a plurality of rear vacuum channels in communication with said vacuum source and extending at least in the initial part of the print zone and a plurality of front vacuum channels in communication with said vacuum source and extending at least in the final part of the print zone, said rear vacuum channels and said front channels being arranged alternated along a scan direction at right angles to said direction of advance of the medium.

14. A method for holding down a medium being printed in an inkjet printing apparatus, comprising the step of controlling the cockle expansion of the medium, at least in a medium output zone arranged downstream of a print zone in the direction of advance of the medium, to be in the form of a wave defined by a plurality of bubbles, said wave being substantially adapted in frequency to a ridged surface of a supporting platen, said supporting platen being in communication with a vacuum source.

15. A method as claimed in claim 14, further comprising the step of inducing at least some of the bubbles to grow downwards in front vacuum channels of the supporting platen.

16. A method as claimed in claim 14, comprising the step of controlling the expansion of the medium in the print zone to be in the form of at least two parallel waves defined by a plurality of bubbles, said waves being alternated such that a downward bubble of one of the waves is adjacent an upward bubble, or no bubble, of an adjacent wave in the direction of advance of the medium.

* * * * *